US005409443A

United States Patent [19]

Zabriskie et al.

[11] Patent Number: 5,409,443

[45] Date of Patent: Apr. 25, 1995

[54] TUBE HOLDER ARRANGEMENT FOR BLOOD CENTRIFUGE

[75] Inventors: B. Dale Zabriskie, Longwood; Randall L. Morrison, Oviedo; Kenneth L. Zabriskie, Longwood, all of Fla.

[73] Assignee: Separation Technology, Inc., Altamonte Springs, Fla.

[21] Appl. No.: 103,242

[22] Filed: Aug. 6, 1993

Related U.S. Application Data

[63] Continuation-in-part of Ser. No. 47,686, Apr. 15, 1993, abandoned.

[51] Int. Cl.[6] ..... B04B 5/02

[52] U.S. Cl. ..... 494/10; 494/7; 494/16

[58] Field of Search ..... 422/99, 100; 436/35; 494/1, 7, 10, 16, 17, 20, 60, 84

[56] References Cited

U.S. PATENT DOCUMENTS

| | | | |
|---|---|---|---|
| 3,115,460 | 12/1963 | McCormick | 494/20 |
| 4,010,893 | 3/1977 | Smith | 494/10 |
| 4,128,400 | 12/1978 | Muhlbock | 494/16 |
| 4,226,669 | 10/1980 | Vilardi | 494/16 |
| 5,067,938 | 11/1991 | Uchida | 494/10 |
| 5,084,133 | 1/1992 | Guy | 494/17 |
| 5,132,087 | 7/1992 | Marion | 422/99 |
| 5,132,232 | 7/1992 | Parker | 422/100 |
| 5,242,370 | 9/1993 | Silver | 494/16 |
| 5,279,150 | 1/1994 | Katzer | 494/10 |

FOREIGN PATENT DOCUMENTS

| | | | |
|---|---|---|---|
| 2097297 | 11/1982 | United Kingdom | 494/16 |

*Primary Examiner*—David A. Scherbel
*Assistant Examiner*—Terrence R. Till
*Attorney, Agent, or Firm*—Warren L. Franz; James H. Beusse

[57] ABSTRACT

A centrifuge (10) for spinning blood sample tubes (14) has a conical rotor head (17) rotated within a cavity defined by an upwardly open annular trough (39) and a domed lid (50). The tubes (14) are inserted into transparent plastic tube holders (48). The holder top ends (60) are funnel-shaped to capture spillage and enable manual gripping. The trough has oppositely sloping walls (40, 41) and holder bottom ends (59) are exposed for ready viewing below the head bottom edge. A reader station (15) includes a pointer (80) with a lens (86) that has hairlines (87) for aligning the pointer over the spin tube (14*a*) to enter data on the red cell/plasma interface. The lines (87) are spaced to match the diagonal appearance of the interface. An interlock assembly includes a solenoid operated shuttle arm (108) that blocks movement of a pin (95) out of a bore (94) in a lid tab (92), unless motor (23) is deenergized.

23 Claims, 5 Drawing Sheets

TUBE HOLDER ARRANGEMENT FOR BLOOD CENTRIFUGE

This is a continuation-in-part of application Ser. No. 08/047,686, filed Apr. 15, 1993, now abandoned, entitled "Blood Centrifuge With Improved Tube Viewing and Motor Interlock," the full disclosure of which is incorporated herein by reference.

This invention relates to centrifuges, in general; and, in particular, to centrifuges having holders useful for spinning blood sample tubes for determining hematocrit and other blood related parameters.

BACKGROUND OF THE INVENTION

The use of centrifuges is common in hematology for the preparation and spinning of plasma and serum blood samples. Centrifugation causes the incrementally more dense red blood cells to separate out from the remaining plasma. This is useful for determining the packed cell volume hematocrit value of whole blood, as well as for determining other hematological parameters.

A typical centrifuge of the type to which the present invention relates, is a hematocrit centrifuge such as disclosed in U.S. Pat. No. 4,738,655, and sold commercially under the brand name HemataSTAT TM by Separation Technology, Altamonte Springs, Fla. HemataSTAT TM models C-70 and C-70B, for example, comprise steep angle rotor heads providing reduced sample preparation spin times and including built-in, digital hematocrit reading capabilities. Though the invention is particularly applicable to such devices which are designed to determine hematocrit values using capillary tube samples, the invention has broader application to larger tube centrifuges, as well.

To determine the hematocrit value using a microcentrifuge, like the HemataSTAT TM centrifuge, a sample of blood is first drawn into a capillary tube (typically a 75 mm heparinized capillary tube of either 0.5 mm or 1.1 mm inside diameter) using a lancet. One end of the tube is sealed, such as with a clay plug, after drawing the sample. The filled and sealed tube is then inserted, clay end down, into one of a plurality of tube holders located in inwardly and upwardly directed channels, angularly-spaced about the centrifuge head. After spinning the sample, the tube is removed from the holder and placed in a horizontal groove located at a reader station on the front of the centrifuge. Blood component interface data entries are made (viz. positions of clay/red cell, red cell/plasma and plasma/air interfaces marked) with the aid of a sliding pointer and data entry buttons. Relative volume calculations are then performed by a microprocessor, using identified pointer positions and known tube diameter, resulting in the display of hematocrit and estimated hemoglobin on an associated LCD display.

Existing tube holders are narrow stainless steel tubes, closed at one end and flared out to form a lip at the other. They are slid, closed end first, snugly into the rotor head channels, until the flared ends are flush with the top of the head. Though the open ends are flared, the expansion is only slight and cannot readily be gripped by the fingers for removal. Instead, conventional practice is to insert a pipe cleaner into the open end to retrieve the holder out of the channel. Because of the narrowness of the holders, tube insertion must be done carefully to avoid breakage. Also, conventional tube holders are cylindrical members with circular flared ends. So care must be taken in handling the holders that they don't roll off the table onto the floor. Moreover, holder clean-out is inhibited and bleach must be heavily diluted to avoid damage to the soldered joints.

There is increasing concern among persons working with blood samples that they will become infected with biological contaminants active in the blood. It is, therefore, a desirable objective to minimize the risk of biological hazard associated with tube breakage, blood spillage and airborne contaminants that may occur during the blood tube centrifugation spin cycle.

Conventional microcentrifuges have small insertion ports that look down on the head and provide only very limited fields of view. The center of the lid is transparent to enable a user to verify cessation of rotation before opening the lid. It is difficult to use such ports for visual inspection of the spin cavity interior to check for evidence of tube breakage and sealant plug blowout or leakage. Also, because the tube holders are opaque, external visual inspection of the condition of the tubes or build-up of clay or other debris within the holders is not possible.

SUMMARY OF THE INVENTION

It is an object of the present invention to provide an improved tube holder and tube holder arrangement for a centrifuge, and especially for a centrifuge usable to spin blood samples and determine hematocrit and other hematological parameters based on the spun samples.

It is another object of the invention to provide blood centrifuge apparatus, and particularly microhematocrit centrifuge apparatus, utilizing such improved tube holder and tube holder arrangement.

In one aspect of the invention, a centrifuge suitable for spinning blood samples employs transparent plastic tube holders respectively inserted in upwardly and inwardly sloping channels of a simplified conical rotor head. Each includes a sealed bottom end and an open top end having a funnel-shaped enlargement that protrudes above the respective channel opening. The enlargement is dimensioned, configured and adapted to facilitate placement of a tube into the holder, and to enable manual grasping of the holder at the enlargement, for ready withdrawal of the holder from the associated head channel. An external surface of the enlargement is configured with angularly displaced discontinuities to impede the rotation of the holder along a flat surface.

The improved tube holder arrangement is augmented by the provision of an improved outwardly sloping well on the centrifuge. The well provides a trough annularly about an elevated drive motor mounting for spillage containment and, together with a wide field of view and fully transparent dome lid, enables ready viewing of the tubes within the holders mounted on the rotor head.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

The features of the invention are described with reference to an exemplary embodiment of a centrifuge 10, shown in FIGS. 1–2, including a spin station 12 for spinning blood samples drawn into capillary tubes 14, and including a built-in reader station 15 for determining hematocrit value based on the spun samples.

Figure 10:
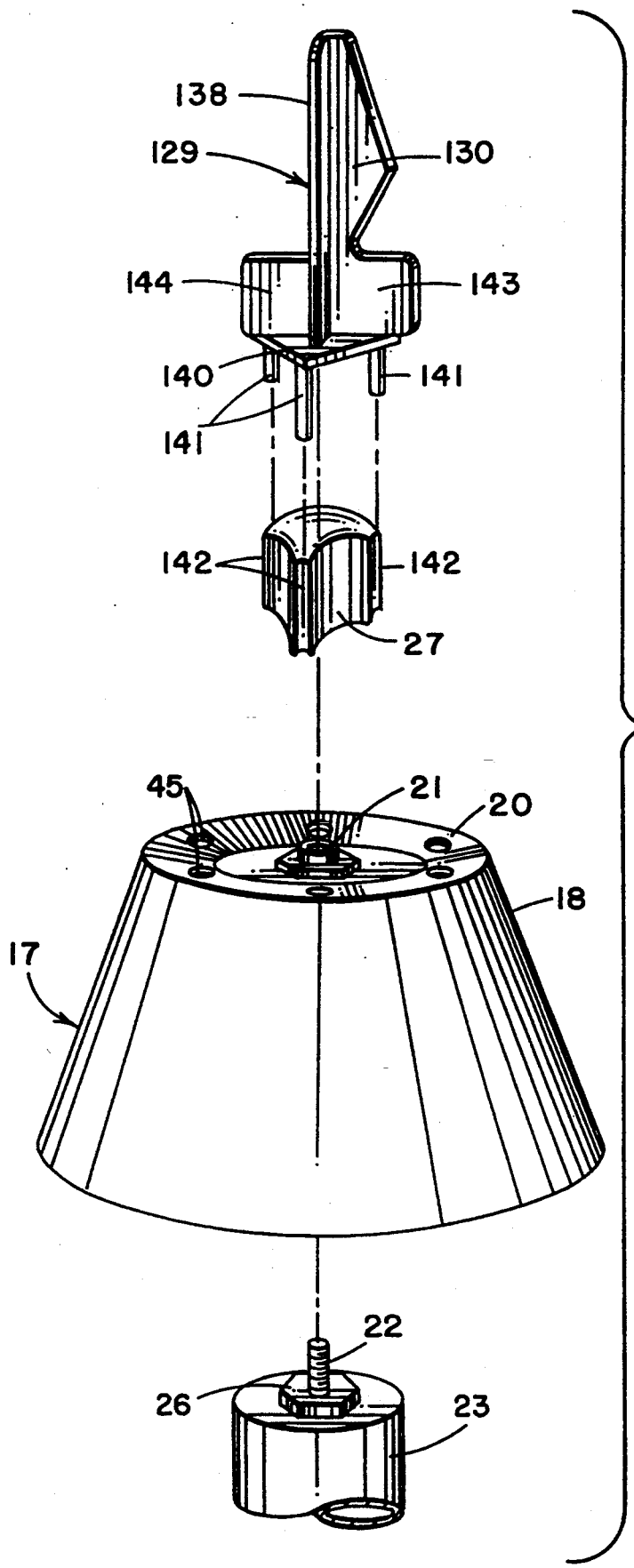
FIG. 10 is an exploded view showing the components for mounting the rotor head on the motor shaft.

Spin station 12 is located centrally within a cavity of housing shell 16. A hollow frusto-conical rotor head 17 having an upwardly and inwardly inclined conical wall 18, capped at its upper end by a horizontally extending disc-shaped top 20 (FIGS. 2 and 3), is located within the cavity. Rotor head top 20 includes an axial bore 21 coaxially mounted on a spindle in the form of a vertical drive shaft 22 of a conventional electrical drive motor 23 (see FIG. 10). Top 20 is concave on its upper surface providing a sloped annulus surrounding a depressed circular middle region. A raised portion at the center provides a hexagonal cross-sectioned hollow 24 opening onto the underside of top 20 (FIGS. 2 and 4) that is mated over a corresponding hexagonally cross-sectioned, horizontal mounting plate 26 (FIG. 10) coaxially located near the upper end of shaft 22. A hub 27 (FIGS. 2 and 3), of larger diameter than bore 21, threads down over top 20 onto shaft 22 to secure head 17 in place.

Figure 3:
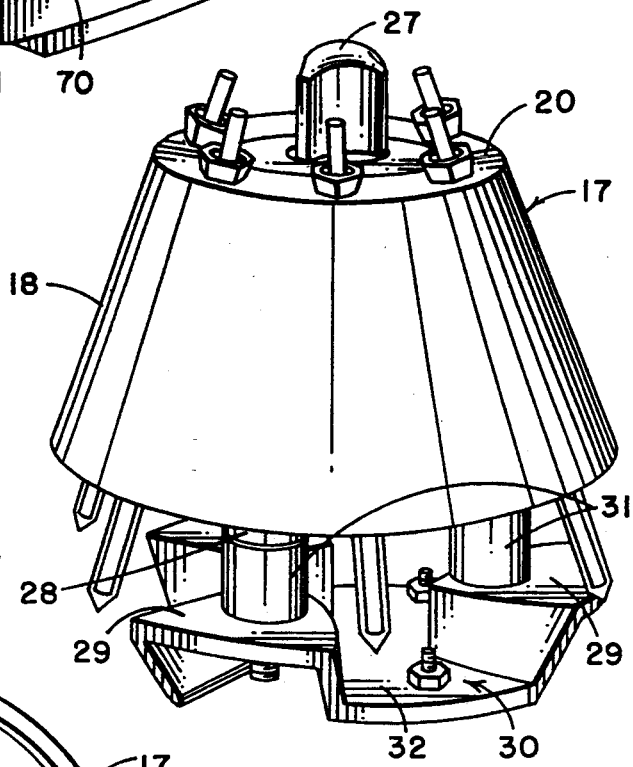
FIG. 3 is a perspective view of the rotor head and motor mount elements of the centrifuge of FIGS. 1 and 2.
Figure 4:
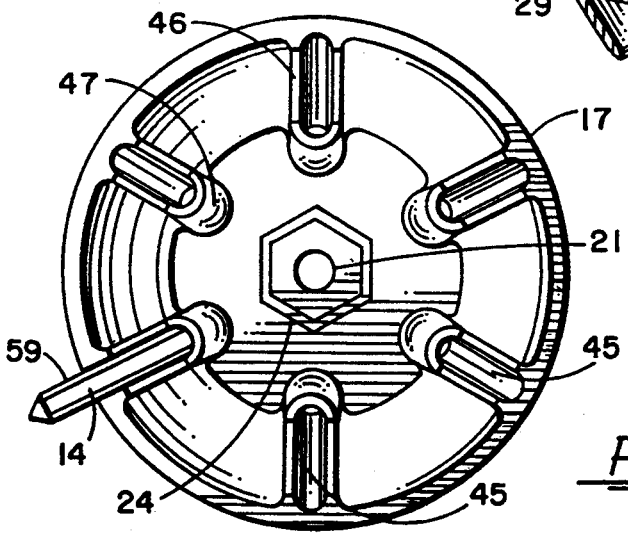
FIG. 4 is a bottom plan view of the rotor head of FIG. 3.

Motor 23 is fixed by three equal radially distributed lobes 28 onto corresponding three evenly-spaced raised platforms 29 of a tripod motor mount unit 30 (see FIG. 3). Resilient cylindrical members 31, interposed between lobes 28 and platforms 29, provide vibration damping and shock-resistance for motor 23. A circular base 32 of motor mount 30 is secured to the housing 16 superstructure by attachment to a horizontal mounting plate 34 (FIG. 2) spaced above housing floor 35. The space between plate 34 and floor 35 is used to locate a rechargeable battery pack 37 which can serve to power motor 23.

A well or moat 38 is provided annularly about motor mount unit 30 to define the bottom of the cavity of spin station 12. Well 38 is provided by an upwardly open annular trough 39 having radially spaced, continuous inner and outer circular walls 40, 41. Wall 40 slopes upwardly and inwardly, whereas wall 41 slopes upwardly and outwardly. The slope of wall 40 is generally matched to the slope of wall 18 and extends upwardly from trough floor 42 to a point within the hollow interior of head 17. The top edge of wall 40 provides the circumference of an elevated circular deck 43 which has an axial opening 44 through which the upper end of motor 23 projects.

A plurality of upwardly and inwardly inclined cylindrical channels 45 are provided on the inside of wall 18, having top openings equiangularly spaced at intervals circumferentially about the sloped periphery of top 20. Concave ribs 46 (FIG. 4) on the inside of wall 18 form the outer boundaries of channels 45. The inner boundaries are formed by tubular sleeves 47 directed downwardly from the channel top openings. The sleeves 47 terminate above the elevation of platform 43, so that tube holders 48 inserted within channels 45 can be brought, without interference, into close proximity with the wall 40. The channels 45 are dimensioned, configured and adapted to receive respective tube holders 48 snugly and coaxially therein. The lower edge of wall 18 terminates below the elevation of platform 43 and is located relative to the bottoms of tube holders 48 and well 38, so that the bottom one-quarter to one-third of holders 48 will be exposed below wall 18, in front of wall 40. Wall 41 is spaced from wall 40 and angled so that the exposed lower ends of holders 48 can be readily viewed from above the trough. To improve tube viewability, wall 40 may optionally be formed of, or coated with, a light reflective material. A horizontal ledge 49 extends marginally, circumferentially about the upper edge of wall 41.

Figure 1:
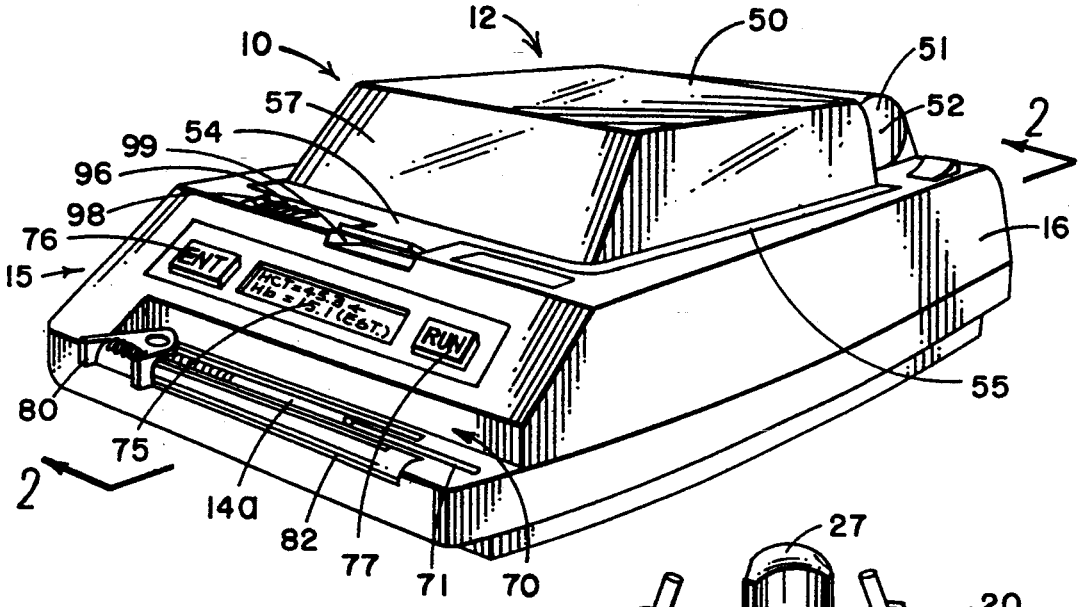
FIG. 1 is a perspective view of a centrifuge utilizing the improved tube holder arrangement of the invention.
Figure 2:
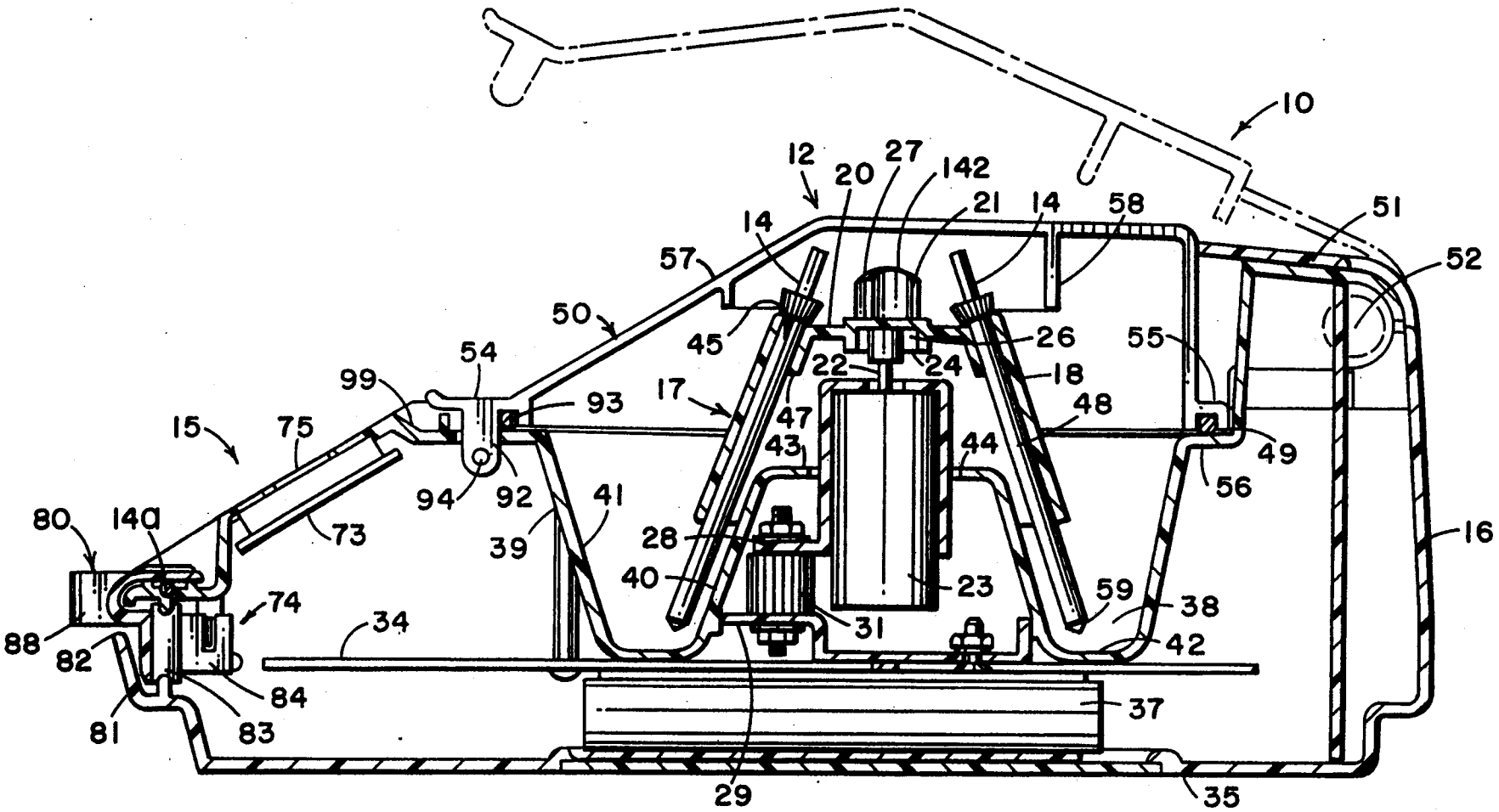
FIG. 2 is a section view taken along the line 2—2 of FIG. 1.

The top of the cavity of spin station 12 is defined by a domed lid 50 (FIGS. 1 and 2). Lid 50 includes a rearward extension 51 pivotally attached by a hinged connection to complementary portions of housing 16, so that lid 50 can be raised and lowered about a laterally extending horizontal axis 52. The front of lid 50 includes a forwardly projecting handle 54 which acts as a manual grip to assist such raising and lowering. A horizontal marginal flange or lip 55 extends peripherally out from the central domed portion of lid 50, for abutment over ledge 49 when lid 50 is lowered into its closed position. A gasket 56 captured in a groove running about the underside of lip 55 ensures a seal against leakage of airborne particles out from the interior of spin station 12, when lid 50 is closed. The central domed portion of lid 50 is elevated above lip 55 by an amount so that a major portion of the height of wall 18 lies above the elevation of lip 55. A rectangular portion 57 at the front of lid 50 is angled up from the top edge of wall 41 to the top of a tube 14 inserted within a forwardmost one of the holders 48 in channels 45. At least portion 57, and preferably all of lid 50 is made transparent (or at least semi-transparent, e.g. smoked). Portion 57 and trough 39 are dimensioned and configured so that the entire length of the forwardmost tube 14 and holder 48 above wall 18, as well as the entire length of holder 48 below wall 18, are readily viewable.

A continuous circular flange 58 depends centrally from the undersurface of lid 50 peripherally above top 20 of the mounted head 17. The inside diameter of flange 58 is less than the outside diameter of the lower edge of wall 18, and flange 58 depends below the elevation of the tops of holders 48. In this way, flange 58 serves several functions. The transparent part of dome 50 circumscribed by flange 58 functions as a focused viewing window to provide visual confirmation of cessation of rotor movement prior to opening the lid. In addition, the vertical inside surface of flange 58 serves as a splash shield to direct any spillage that might occur during spinning, downwardly onto the outside surface of angled wall 18, for drainage into well 38. This keeps blood and glass away from the area of gasket 49 and away from portions of lid 50 that are contacted by the user in opening the device.

Figure 5:
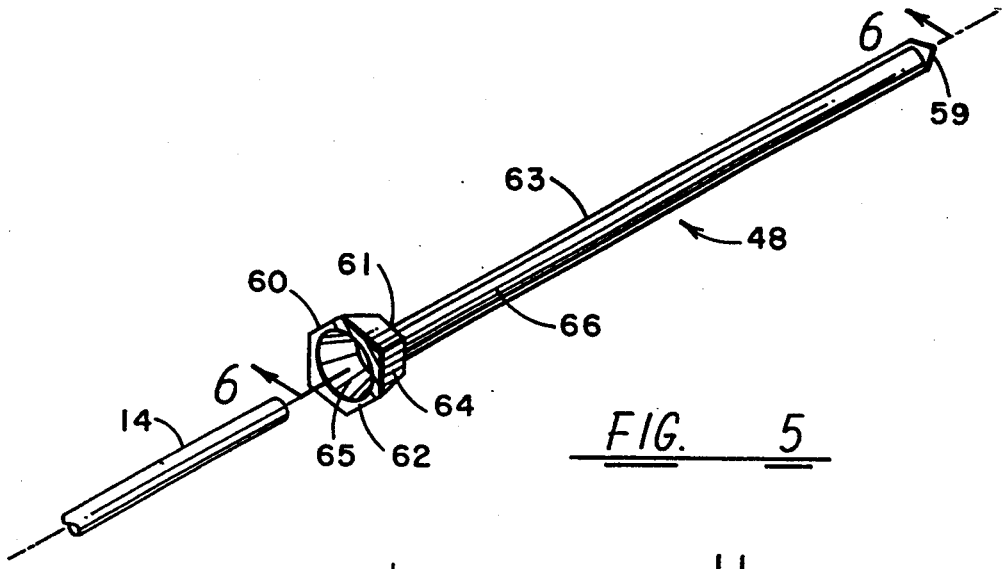
FIG. 5 is a view showing insertion of a tube into an improved tube holder.
Figure 6:
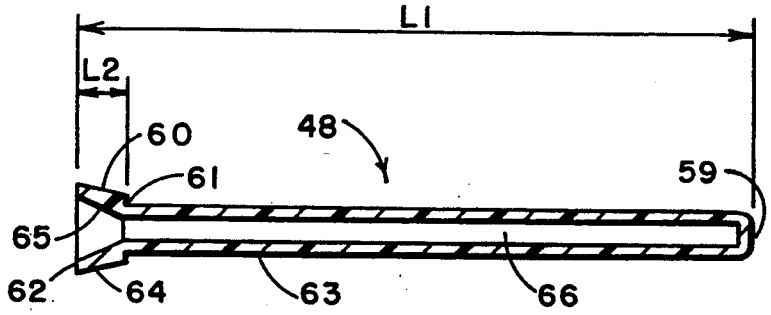
FIG. 6 is a section view of the holder, taken along the line 6—6 of FIG. 5.

In accordance with the invention, the holders 48, in departure from conventional soldered tube construction, are made of transparent material, preferably plastic. Each holder 48 has a sealed bottom end 59 and an open top end 60 (FIGS. 5 and 6). The holder is of hollow cylindrical tubular configuration having inside dimensions chosen to accommodate the corresponding outside dimensions of tubes 14. In contrast with the slight flaring designed to be brought flush with the tops of channels present in conventional holders, each holder 48 includes a much more pronounced enlargement having a clearly defined shoulder at its base 61 and a relatively much more significantly enlarged dimension at its upper end 62. The base 61 of the enlargement 60 performs the same function as the slight flaring of prior art holders, i.e. to provide a surface to contact the edge of the top of channel 45 to maintain the holder in place. However, unlike prior art holders which exhibit a continuous flaring, the base 61 provides a flat annular surface which meets the outside surface of the main body portion 63, abruptly at 90°. Moreover, the perimetrical outside edge of base 61 is not circular, but hexagonal. The top 62 is configured similarly to the base 61, having a hexagonal outside edge with an outside dimension across the flats of about one-third greater than the corresponding dimension of the hexagonal outside edge of base 61, and having a circular inside edge of diameter almost two times greater than the corresponding circular outside diameter of the uniform cylindrical shape of main body portion 63. The intermediate portion between base 61 and top 62 of enlargement 60 is characterized by a plurality of flat trapezoidal surfaces 64 having bases coincident with the sides of the hexagonal outside edge of base 61 and tops coincident with the sides of the hexagonal outside edge of top 62. The discontinuities provided by the common side edges of adjacent trapezoids 64 serve to impede rolling of the holders 48 across tables, countertops and the like.

For an approximately 2½" length of body 63, the length of the enlargement 60 may, for example, be about ⅛". This design provides a funnel-shaped mouth area 65 about the inserted tube 14 at the top of holder 48, that assists in capturing spillage from the open end of the tube. A continuous upward increase in inside diameter at the top end 60 also facilitates insertion of the sealed end of tube 14 into the interior of body portion 63. A continuous much less pronounced, slight upward increase in inside diameter of main body 63 is also appropriate to guide the sealed end of tube 14 into the general cylindrical interior chamber 66 between the enlargement 60 and the tube bottom end 48. A like tapering of the outside of body 63 serves the same purpose for guiding holder 48 into channel 45. Moreover, the relatively large size of enlargement 60 permits it to be manually gripped with a gloved hand for ready insertion into or removal from head 17. An exemplary holder 48 may suitably be dimensioned to have a 2.62" overall length L1 (distance between bottom end 59 and top end 62, see FIG. 6); a 0.188" length L2 of enlargement 60 (distance between base 61 and top 62); a diameter of chamber 66 at the bottom end 59 of 0.085"; a diameter of mouth 65 and chamber 66 at base 61 of 0.095"; a diameter of mouth 65 at top 62 of 0.26"; an outside diameter of body 62 at bottom end 52 of 0.158"; an outside diameter of body 62 at base 61 of 0.180"; a base 62 dimension across hexagonal edge flats of 0.26"; and a top 62 dimension across hexagonal edge flats of 0.34". A suitable material for molding tube holder 48 is a styrene-butadeine K-resin. The preferred plastic construction does not have the cleaning drawbacks (viz. bleach dilution requirement) inherent in the use of conventional soldered metal members.

Figure 7:
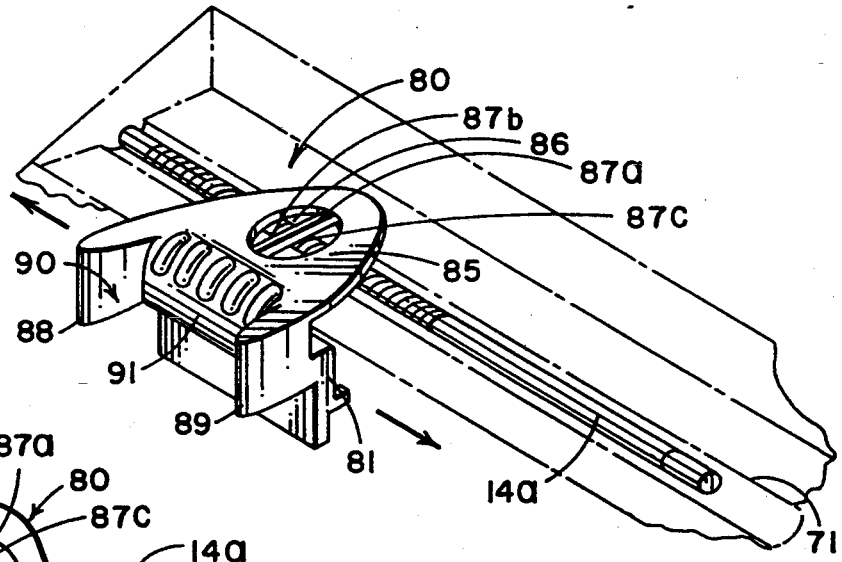
FIG. 7 a fragmentary view showing the pointer element in use to mark blood tube interface locations at a reader station.
Figure 8:
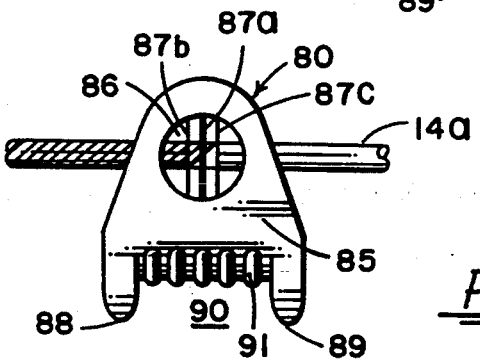
FIG. 8 is a top view of the pointer element of FIG. 7.

Reader station 15 of centrifuge 10 may be formulated in accordance with conventional teachings to provide a horizontal data entry platform 70 (FIG. 1), including a laterally-extending horizontal groove 71 into which a tube **14*a* containing a spun blood sample can be coaxially placed. The reader includes microprocessor electronic circuitry 73 (FIG. 2), connected for input from an interface position determining assembly 74 and connected for output to an LED display 75. The circuitry 73 may be separate from or integrated with electronic components for control of operation of motor 23. For the illustrated integrated arrangement, user input is provided by operation of "ENT" data entry button 76, "RUN" spin cycle activate button 77, and a slidable pointer element 80 (see also FIGS. 7 and 8**).

Pointer 80 is mounted with a lower, rearwardly-directed portion 81 received through a track opening 82 (FIGS. 1 and 2) internally within housing 16 and connected for lateral sliding motion together with a movable carriage 83 (FIG. 2). A linear optical encoder 84 or similar conventional means is established within housing 16 for sensing the lateral position of carriage 83 and, thus, of pointer 80. Seen from above, and similar to the configuration of prior art pointers, pointer 80 has a generally parabolic, blunted arrow shaped top surface. However, unlike prior art pointers, the "point" of the top surface does not travel along the lateral front edge of groove 71. Instead, the "point" extends over groove 71, from one side to the other, so that a central region 85 of the parabolic pointer top lies over the groove 71. And, instead of an arrow index serving to line the "point" up with an interface, a transparent circular lens 86 is formed in the region 85, through which the underlying part of tube **14*a* can be viewed. Lens 86 includes indicia in the form of three hairlines 87 (FIGS. 7 and 8) oriented to be at right angles to the longitudinal axis of groove 71 and, thus, of tube 14*a*. For alignment of pointer 80 with the, usually straight, clay/red cell and plasma/air interfaces, the center line 87*a* is placed over the interface. Because the region 85 is depressed and the user looks down onto the lens 86, parallax errors will be less than with prior art pointers. For alignment of pointer 80 with the, usually angled, red cell/plasma interface, the center line 87*a* is placed over the center of the interface. This procedure is facilitated by the presence of left and right lines 87*b*, 87*c* which are spaced by equal amounts to the left and right, respectively, of center line 87*a*. As seen with reference to FIG. 8, the center of the diagonal interface can be found by centering the entire interface between the left and right lines 87*b*, 87*c*. To facilitate this process even more, it is preferred to darken the center line 87*a* relative to the outer lines 87*b*, 87*c* and to space the lines relative to the inside diameter of the tube 14*a* and angling of channels 45, so that the spacing between the outer lines 87*b*, 87*c* will match the length in the tube longitudinal axial direction of the usual red cell/plasma interface to be encountered. To improve visibility and alignment, lens 86 advantageously has a magnification factor, so the underlying tube appears enlarged in the lens field of view. 640×length in the tube For more positive control of sliding action (and correspondingly more efficient accurate placement), pointer 80 is provided with two generally longitudinally extending, forwardly projected lobes or ears 88, 89, laterally-spaced across a gap 90 bounded rearwardly by a downwardly extending forward surface 91 of the pointer 80. The lateral spacing of lobes 88, 89 is chosen so that pointer 80 can be moved both by placing a finger between lobes 88, 89 and, alternatively, by gripping non-facing outside surfaces of lobes 88, 89 between the thumb and forefinger. Such configuration greatly facilitates rapid correct placement of pointer 80** over the appropriate interface.

Figure 9:
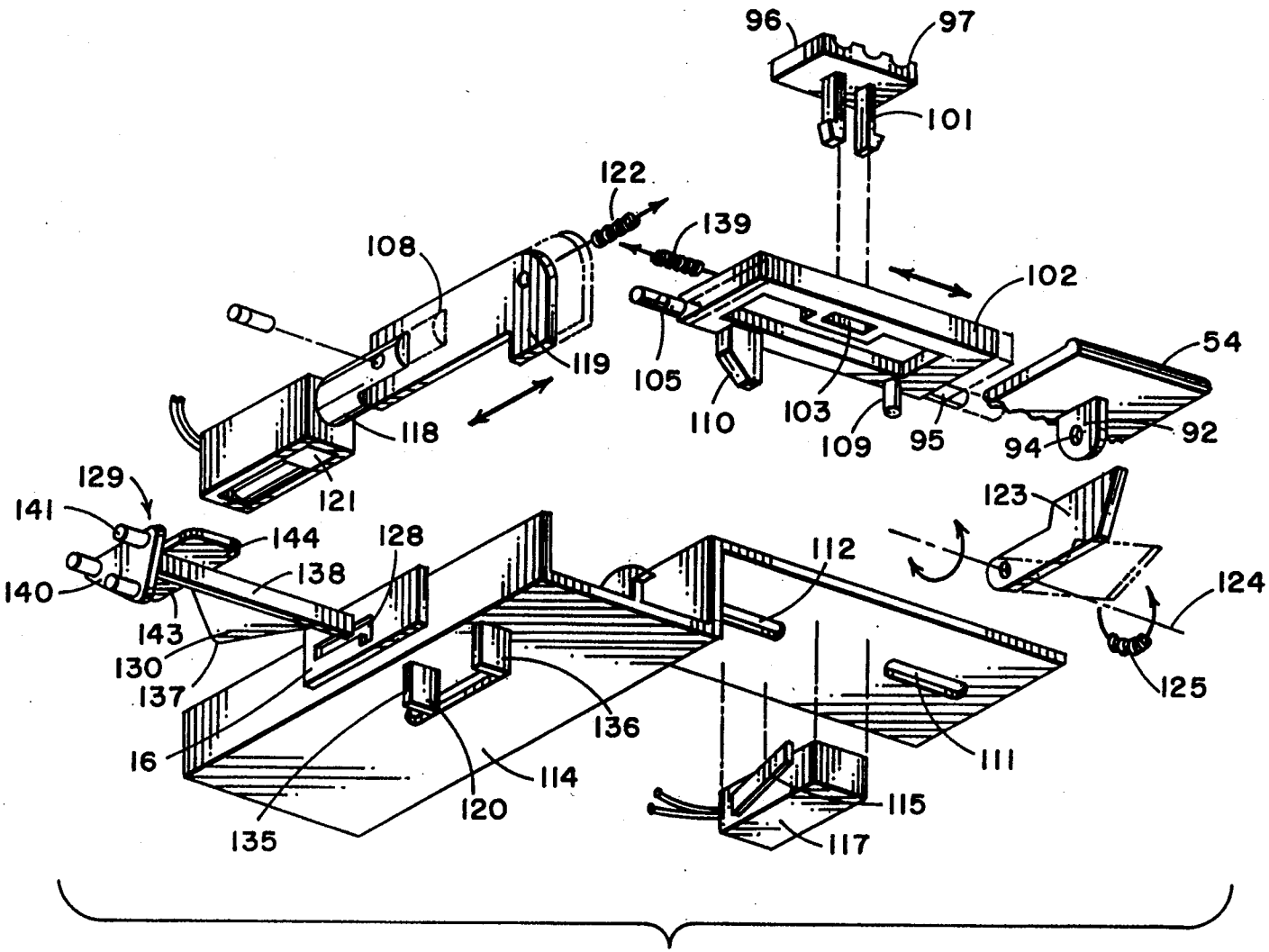
FIG. 9 is an exploded view showing the components of an exemplary interlock assembly.

The components of an exemplary interlock assembly are shown in FIG. 9. As already mentioned, lid 50 (FIG. 1) includes a handle 54 to assist raising and lowering lid 50 about the pivotal axis 52. Handle 54 includes a centrally located, vertically depending tab 92 (FIGS. 2 and 9) that projects downwardly through an opening 93 (FIG. 2) in housing shell 16 when lid 50 is closed. Tab 92 includes a lateral bore 94 through which a latch pin 95 (FIG. 9) may be driven in response to user lateral movement of a slide button 96 (see also FIG. 1). A ribbed contact pad 97 of slide button 96 is accessible within a lateral recess 98 at the top of housing 16 to the left of handle groove 99. Pin 95 is located at one end of a latch member 102. A bifurcated post 101 connects pad 97 through shell 16 to latch member 102 by snap-fit attachment into slot 103. The other end of latch 102 includes an oppositely directed pin 105 which can be aligned with a forward end of a shuttle arm 108. Latch 102 is mounted on housing 16 for relative left-right lateral movement whose limits are defined by vertically directed guide elements 109, 110, which pass respectively through lateral slots 111, 112 formed in latch frame 114. Element 109 is a depending guide pin that journeys left and right within slot 111. Element 110 is a vertical fixed lever arm protruding from latch 102 that journeys left and right within the confines of slot 112. When element 110 is moved to its rightmost position, it triggers an actuator arm 115 of a microswitch sensor component 117, which is mounted on the undersurface of frame 114 at the right end of slot 112. Switch 117 sends either an enable or disable signal (depending on position of arm 115) to the microprocessor control circuit 73.

Arm 108 is disposed for longitudinal movement relative to housing 16, under control of a solenoid armature 118. Arm 108 includes a longitudinal tab 119 that is captured within the confines of a longitudinal slot 120 of frame 114. Arm 108 and latch 102 are relatively dimensioned, configured and adapted so that, when tab 119 is in its rearmost position (shown by solid lines in FIG. 9), pin 105 will clear the leading edge of tab 119; and so that, when tab 119 is in its foremost position (shown by dot-dashed lines in FIG. 9), pin 105 will be obstructed by tab 119. When arm 108 is positioned rearward, latch 102 can be shifted to the left, releasing tab 92. When arm 108 is in its foremost position, leftward shifting of latch 102 is prevented. A permanent magnet 121 acts to latch armature 118 and, thus, arm 108 in its rearward, latch nonblocking position. A spring 122 (shown schematically in FIG. 9) connects between arm 108 and housing 16 to bias arm 108 into its forward, latch movement blocking position.

The interlock mechanism includes a safety stop element 123 mounted for pivotal movement relative to housing 16, about a lateral axis 124. A spring 125 biases stop 123 into a position blocking rightward movement of pin 95. Stop 123 is located so that closing lid 50 will cause tab 92 to move stop 123 downward (from its solid line to its dot-dashed line position in FIG. 9), against the bias of spring 125. This action will remove the block to rightward movement of pin 95, by bringing bore 94 into alignment with pin 95.

A keyhole slot 128 is provided in the left side of housing 16 to enable manual insertion of a complementary cross-sectioned portion of a key 129, to bring a cam surface 130 of key 129 into contact with the lower portion of the forward edge of tab 119. This enables movement of arm 108 backward against the bias of spring 122, to provide clearance for pin 105 relative to the front section of arm 108. Spaced guide plates 135, 136 contact an outer edge 137 of cam 130 and an opposite edge surface of an axial brace 138 of key 129, to direct and provide support for the cam action. The gripped end of key 129 has a triangular plate 140 from the vertices of which extend three posts 141 which can be mated with corresponding three vertical grooves 142 formed at the corners of a triangular cross-sectioned hub 27 for the purpose of rotating internal threading for attaching and removing hub 27 from the threaded upper end of shaft 22 (see FIG. 10). Oppositely directed wings 143, 144 project laterally from brace 138, adjacent plate 140 to provide surfaces against which the user's fingers can act for rotating key 129. A hollow, configured to match the contour of key 129, is advantageously provided in the wall of the base of housing shell 16 (see FIG. 15) for removably storing key 129 in a readily accessible, out-of-the-way location. The illustrated hollow has a horizontal platform for receiving two of the posts 141 located below a bore (not shown) for receiving the third post 141. The hollow is dimensioned longitudinally to match the length of key 129, and the platform is dimensioned laterally to match the spacing between posts 141. This will fit key 129 into the hollow and retain it there, if the upper post is first inserted in the bore, before the cam end is placed in the hollow. The hollow is enlarged laterally in the portion that receives wings 143,144 in order to provide room to grip wings 143, 144 for positioning key 129 into and out of the hollow.

In operation, stop 123 is moved from its solid line to its dot-dashed line position in FIG. 9 by insertion of tab 92 into opening 93 when lid 50 is closed. This brings bore 94 of tab 92 into alignment with latch pin 95, enabling latch 102 to be shifted to the right dot dashed position by manually moving pad 97 likewise to the right. Such movement brings pin 95 into bore 94, locking handle 54 in the lid-closed position. Simultaneously, such movement moves pin 105 out of the way of arm 108, enabling arm 108 to shift to its dot-dashed line forward position under action of spring 122. Clearance is now no longer provided for pin 105, so latch 102 cannot be shifted to the left and pin 95 cannot be withdrawn from bore 94. The lid is, thus, locked.

The locked position is made known to microprocessor circuit 73 because actuator arm 115 of microswitch sensor 117 is depressed when guide element 110 is shifted to the right within slot 112. The microprocessor is programmed so that pressing the "RUN" button 77 in the presence of the locked signal from switch 117 will enable the start of motor 23 for the spin cycle. Pressing the "RUN" button 77 in the absence of such signal will not start the motor. Lid 50 will remain locked until the spin cycle is completed, at which time circuit 73 will send a signal to the solenoid for armature 118 to draw arm 108 back to its rearward position (shown by solid lines in FIG. 9), wherein clearance is again established between pin 105 and arm 108. When this happens, pad 97 can again be manipulated to move latch 102 to the left, thereby unlocking lid 50 for opening. If desired, means such as a spring 139 can be utilized to provide biasing, so that the unlocking will occur automatically upon mere momentary energization of solenoid 118. Key 129 provides means by which arm 108 can be manually moved to unlock lid 50, if necessary to override the interlock mechanism.

Those skilled in the art to which the invention relates will appreciate that other substitutions and modifications can be made to the described embodiments, without departing from the spirit and scope of the invention as described by the claims below.

What is claimed is:

1. A centrifuge suitable for spinning blood samples in tubes, said centrifuge comprising:

a housing having an upwardly open trough defining a bottom of an internal cavity;

a lid defining a top of said cavity;

a motor mounted in said housing and including a drive shaft;

a rotor head received within said cavity and coupled to said drive shaft for rotation by said motor about an axis; said rotor head being provided with a conical wall having a lower edge and a plurality of upwardly and inwardly inclined channels located inside said wall, said channels having top and bottom openings and being angularly spaced at intervals circumferentially about said axis; and a plurality of tube holders respectively inserted within said channels; said tube holders being of hollow tubular configuration with open top ends and sealed bottom ends; said open top ends having enlargements that are larger than said channel top openings; said bottom ends extending below said lower edge of said wall; said holders being transparent at least at said bottom ends; and said trough, lid, rotor head and holders being relatively dimensioned, configured and positioned so that tubes inserted within said holders can be readily viewed through said transparent bottom ends.

2. A centrifuge as in claim 1, wherein said enlargements are hollow frusto-conical enlargements having bases which present flat annular surfaces brought flush with the tops of the channels.

3. A centrifuge as in claim 2, wherein said tube holders have main body portions of given outside diameter; and said enlargements have tops of outside diameter two times greater than said given outside diameter.

4. A centrifuge as in claim 3, wherein said main body portions have given lengths, and said enlargements have lengths at least 1/20th as large as said given lengths.

5. A centrifuge as in claim 1, wherein said tube holders are fully transparent.

6. A centrifuge as in claim 1, wherein said enlargements define funnel-shaped mouth areas at said top ends of said holders, and said mouth areas are dimensioned and configured to assist in capturing spillage from top ends of tubes inserted in said holders.

7. A centrifuge as in claim 1, wherein said trough includes an outer wall sloping upwardly and outwardly away from said holder bottom ends.

8. A centrifuge as in claim 7, wherein said rotor head has a hollow interior, and said trough includes an upwardly and inwardly sloping inner wall having a top edge located within said hollow interior.

9. A centrifuge as in claim 8, wherein the slope of said inner wall matches the incline of said channels.

10. A centrifuge as in claim 7, wherein said outer wall has an upper edge, said housing includes a ledge extending marginally, peripherally about said upper edge; and said lid includes a marginal, peripheral lip and is mounted on said housing for movement between a closed position wherein said lip is brought over said ledge, and an open position wherein said lip is removed from said ledge; and said centrifuge further comprises means establishing a seal between said lip and said ledge when said lid is in said closed position.

11. A centrifuge as in claim 1, wherein said rotor head has a top; and said lid has an undersurface and a continuous flange depending centrally from said undersurface peripherally above said top of said rotor head.

12. A centrifuge suitable for spinning blood samples in tubes and for determining hematological parameters based on the spun samples, said centrifuge comprising:

a housing having an internal cavity;

a motor mounted in said housing and including a drive shaft;

a rotor head receiving within said cavity and coupled to said drive shaft for rotation by said motor about an axis, said rotor head including a plurality of upwardly and inwardly inclined channels angularly located at intervals about said axis;

a plurality of tube holders respectively inserted within said channels, said tube holders being of hollow tubular configuration with open top ends and sealed bottom ends; said tube holders being dimensioned and configured for receiving the tubes containing blood samples therein for spinning on said rotor head by said motor to separate the samples into component parts at an interface;

retaining means for retaining a tube in fixed position on said housing, after spinning on said rotor head;

a pointer movably mounted on said housing for travel over the tube retained by said retaining means; said pointer including a transparent lens through which the retained tube can be viewed, and indicia on said lens for aligning said pointer with the interface; and means, connected with said pointer, for entering data in response to positioning of said pointer to point to said interface, and for determining a hematological parameter based on said entered data.

13. A centrifuge as in claim 12, wherein said retaining means is a groove having a longitudinal axis; said pointer is mounted for movement over said groove, longitudinally of said groove axis; and said indicia comprises at least one hairline oriented at right angles to said groove axis.

14. A centrifuge as in claim 13, wherein said indicia comprises equally spaced left, right and center lines, with said center line being darker than said left and right lines.

15. A centrifuge as in claim 13, wherein said indicia comprises left and right lines spaced by an amount corresponding to the length in the groove axial direction of the interface.

16. A centrifuge as in claim 12, wherein said pointer has a parabolic, arrow-shaped top extending over said groove; and said top has a central region including said lens.

17. A centrifuge as in claim 12, wherein said housing has an upwardly open trough defining a bottom of said internal cavity; said rotor head has a conical wall with a lower edge; said channels have top and bottom openings; said tube holders are transparent; said open top ends have enlargements that are larger than said channel top openings; said bottom ends extend below said lower edge; and said trough, rotor head and holders are relatively dimensioned, configured and positioned so that tubes inserted within said holders can be readily viewed through said bottom ends.

18. A centrifuge suitable for spinning blood samples in tubes, said centrifuge comprising:

a housing having an opening and an upwardly open trough defining an internal cavity;

a lid defining a top of said cavity and being mounted on said housing for movement between a closed position wherein said lid closes said upwardly open trough, and an open position wherein said upwardly open trough is left uncovered; said lid including a tab that has a bore and projects downwardly through said opening when said lid is in said closed position;

a motor mounted in said housing and including a drive shaft;

a rotor head received within said cavity and coupled to said drive shaft for rotation by said motor about an axis, said rotor head including a conical wall with a lower edge and a plurality of channels; said channels being upwardly and inwardly angled relative to said axis, being angularly located at intervals about said axis, and having top and bottom openings;

a plurality of tube holders respectively inserted within said channels, said tube holders being transparent hollow tubular elements with open top ends and sealed bottom ends; said open top ends having enlargements that are larger than said channel top openings; said bottom ends extending below said lower edge; and said trough, rotor head and tube holders being relatively dimensioned, configured and positioned so that said tubes inserted within said tube holders for spinning of said samples can be readily viewed through said bottom ends;

switch means for energizing said motor to rotate said rotor head and to deenergize said motor to stop rotation of said rotor head; and means for locking said lid against movement from said closed position to said open position when said motor is energized and until said motor is deenergized;

said means for locking said lid comprising a slide button, a pin, means connecting said slide button and said pin to selectively drive said pin into and out of said bore when said lid is closed, means to prevent said energizing of said motor unless said pin has been driven into said bore, and means to prevent driving said pin out of said bore unless said motor has been deenergized.

19. A centrifuge as in claim 1, further comprising:

retaining means for retaining a tube in fixed position on said housing, after spinning on said rotor head;

a pointer movably mounted on said housing for travel over the tube retained by said retaining means; said pointer including a transparent lens through which the retained tube can be viewed, and indicia on said lens for aligning said pointer with the interface; and means, connected with said pointer, for entering data in response to positioning of said pointer to point to said interface, and for determining a hematological parameter based on said entered data.

20. A centrifuge as in claim 18, wherein said retaining means is a groove having a longitudinal axis; said pointer is mounted for movement over said groove, longitudinally of said groove axis; and said indicia comprises at least one hairline oriented at right angles to said groove axis.

21. A centrifuge as in claim 19, further comprising:

switch means for energizing said motor to rotate said rotor head and to deenergize said motor to stop rotation of said rotor head; and means for locking said lid against movement from said closed position to said open position when said motor is energized and until said motor is deenergized.

22. A centrifuge as in claim 21, wherein said housing includes an opening; said lid includes a tab that has a bore and projects downwardly through said opening when said lid is in said closed position; said centrifuge further comprises a slide button, a pin, and means connecting said slide button and said pin to selectively drive said pin into and out of said bore when said lid is closed; and wherein said means for locking comprises means to prevent said energizing of said motor unless said pin has been driven into said bore, and to prevent driving said pin out of said bore unless said motor has been deenergized.

23. The centrifuge of claim 1 wherein conical enlargements on each of said tube holders have a non-circular perimetrical outside edge for impeding rolling of said tube holders along a support surface.

* * * * *